US005488742A

United States Patent [19]

Liao

[11] Patent Number: 5,488,742

[45] Date of Patent: Feb. 6, 1996

[54] TOILET DISINFECTANT RELEASE APPARATUS

[76] Inventor: Su-Lan Liao, No. 93, Yuan-Huan S. Rd., Feng-Yuan City, Taichung Hsien, Taiwan

[21] Appl. No.: 371,968

[22] Filed: Jan. 12, 1995

[51] Int. Cl.[6] ..... E03D 9/03

[52] U.S. Cl. ..... 4/227.3

[58] Field of Search ..... 4/227.1, 227.2, 4/227.3, 227.4

[56] References Cited

U.S. PATENT DOCUMENTS

| | | | |
|---|---|---|---|
| 633,390 | 9/1899 | Schell | 4/227.4 |
| 2,065,181 | 12/1936 | French | 4/227.3 |
| 3,254,797 | 6/1966 | Porter | 4/227.3 X |

FOREIGN PATENT DOCUMENTS

| | | | |
|---|---|---|---|
| 0304379 | 2/1989 | European Pat. Off. | 4/227.2 |

*Primary Examiner*—Robert M. Fetsuga
*Attorney, Agent, or Firm*—Bacon & Thomas

[57] ABSTRACT

A toilet disinfectant release apparatus includes a housing disposed and supported inside a toilet tank by a U-shaped hanger fitting over a side wall of the toilet tank, into which housing a disinfectant supply control device is mounted. The housing has a convex rim mating a complementarily-shaped edge of an externally mounted disinfectant container to soundly hold the container and allows an opening of the container inserted into the housing. The supply control device has a disinfectant chamber in fluid communication with a piston shaft which has a piston movably received therein. The movement of the piston changes the volume and interior pressure of the disinfectant chamber so as to draw in disinfectant from the disinfectant container and/or inject the disinfectant so drawn in into the housing from a one-way nozzle mounted to the supply control device. The disinfectant so injected mixes with water within the housing and then released to the toilet tank. The movement of the piston is controlled by a buoy which has a rod extending therefrom to connect to the piston. The buoy is in turn moved up and down by water inside the toilet tank and thus the piston moves to and fro once at each time the toilet is flushed so as to draw from the disinfectant container a substantially constant amount of disinfectant into the disinfectant chamber and inject the amount of the disinfectant into the toilet tank.

12 Claims, 6 Drawing Sheets

90
92
920
911
921
912
91
344
342
343
34
30
345
341
331
321
33
322
32
352
323
317
31
35
362
316
315
363
313
37
Y
318
311
310
312
36
361
314
13
12
15
11
110
14
16
10
23
25
X
21
99
210
27
523
27
26
53
52
521
522
50
520
51
511

TOILET DISINFECTANT RELEASE APPARATUS

FIELD OF THE INVENTION

The present invention relates generally to a chemical agent release apparatus and in particular to a toilet disinfectant/cleaning agent release apparatus which releases a substantially constant amount of liquid agent at each flush of the toilet.

BACKGROUND OF THE INVENTION

Toilets have been a must for general daily living. Strange odds frequently occur in the toilets. To eliminate the strange odds and to disinfect, disinfectants or cleaning agent in the form of liquid, solid block and/or paste have employed. Cleaning agents in the form of solid block are used by simply dropping the block into the toilet water tank. The agents will dissolve by being contacted with water. The problem is that it is difficult to control the concentration of the agent within the toilet tank due to the fact that the dissolution of the solid agent into the water is dependent upon the surface area of the block and the surface area of the block reduces with the dissolution of the agent into the water.

The release of the liquid disinfectant into a toilet tank usually makes use of the principle of syphon. The syphon devices, although working well in releasing liquid disinfectant into the toilet tank, do not provide a constant amount or a substantially constant amount of the disinfectant into the toilet tank at each flush.

It is therefore desirable to provide a toilet disinfectant release apparatus which is capable to release a substantially constant amount of liquid disinfectant into the toilet tank at each flush of the toilet to overcome the drawbacks of the conventional devices.

SUMMARY OF THE INVENTION

The principal object of the present invention is to provide a toilet disinfectant release apparatus which is capable to release a substantially constant amount of liquid disinfectant into a toilet water tank at each flush of the toilet.

It is another object of the present invention to provide a toilet disinfectant release apparatus comprising a housing so configured as to mate a separate disinfectant container which is the external supply of the disinfectant to the release apparatus so as to allow the disinfectant container to be soundly held and precisely positioned on the disinfectant release apparatus.

It is a further object of the present invention to provide a toilet disinfectant release apparatus which can be readily mounted into a toilet tank in a location-adjustable manner to suit for different designs of the toilet tanks.

To achieve the above objects, in accordance with the present invention, there is provided a toilet disinfectant release apparatus comprising a housing disposed and supported inside a toilet tank by a U-shaped hanger fitting over a side wall of the toilet tank, into which housing a disinfectant supply control device is mounted. The housing has a convex rim mating a complementarily-shaped edge of an externally mounted disinfectant container to soundly hold the container and allows an opening of the container inserted into the housing. The supply control device has a disinfectant chamber in fluid communication with a piston shaft which has a piston movably received therein. The movement of the piston changes the volume and interior pressure of the disinfectant chamber so as to draw in disinfectant from the disinfectant container and/or inject the disinfectant so drawn in into the housing from a one-way nozzle mounted to the supply control device. The disinfectant so injected mixes with water within the housing and then released to the toilet tank. The movement of the piston is controlled by a buoy which has a rod extending therefrom to connect to the piston. The buoy is in turn moved up and down by water inside the toilet tank and thus the piston moves to and fro once at each time the toilet is flushed so as to draw from the disinfectant container a substantially constant amount of disinfectant into the disinfectant chamber and inject the amount of the disinfectant into the toilet tank.

BRIEF DESCRIPTION OF THE DRAWINGS

The present invention will be better understood from the following description of preferred embodiments of the present invention, with reference to the attached drawings, wherein.

DETAILED DESCRIPTION OF THE PREFERRED EMBODIMENTS

Figure 1:
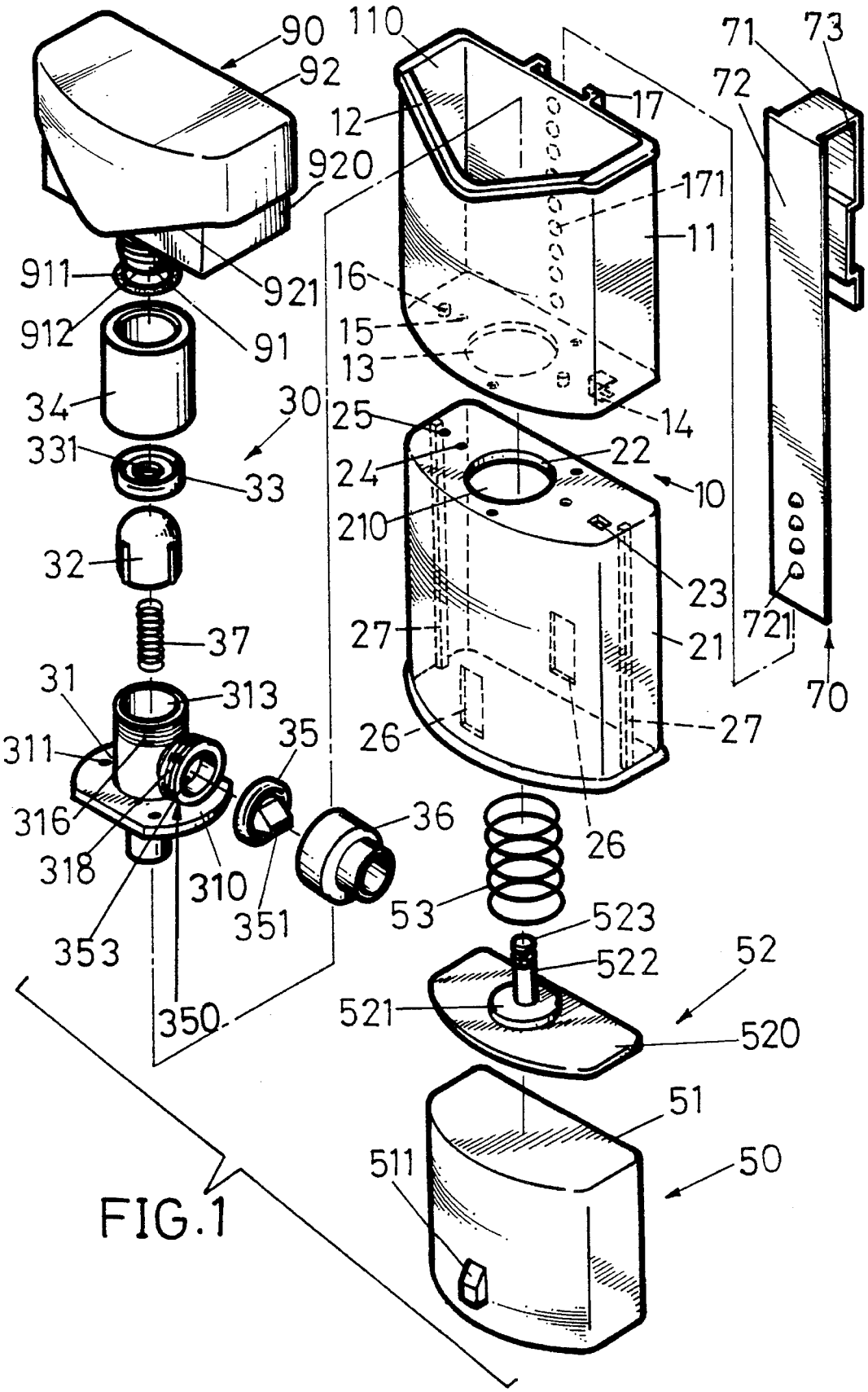
FIG. 1 is an exploded perspective view showing a toilet disinfectant release apparatus constructed in accordance with an embodiment of the present invention.
Figure 3:
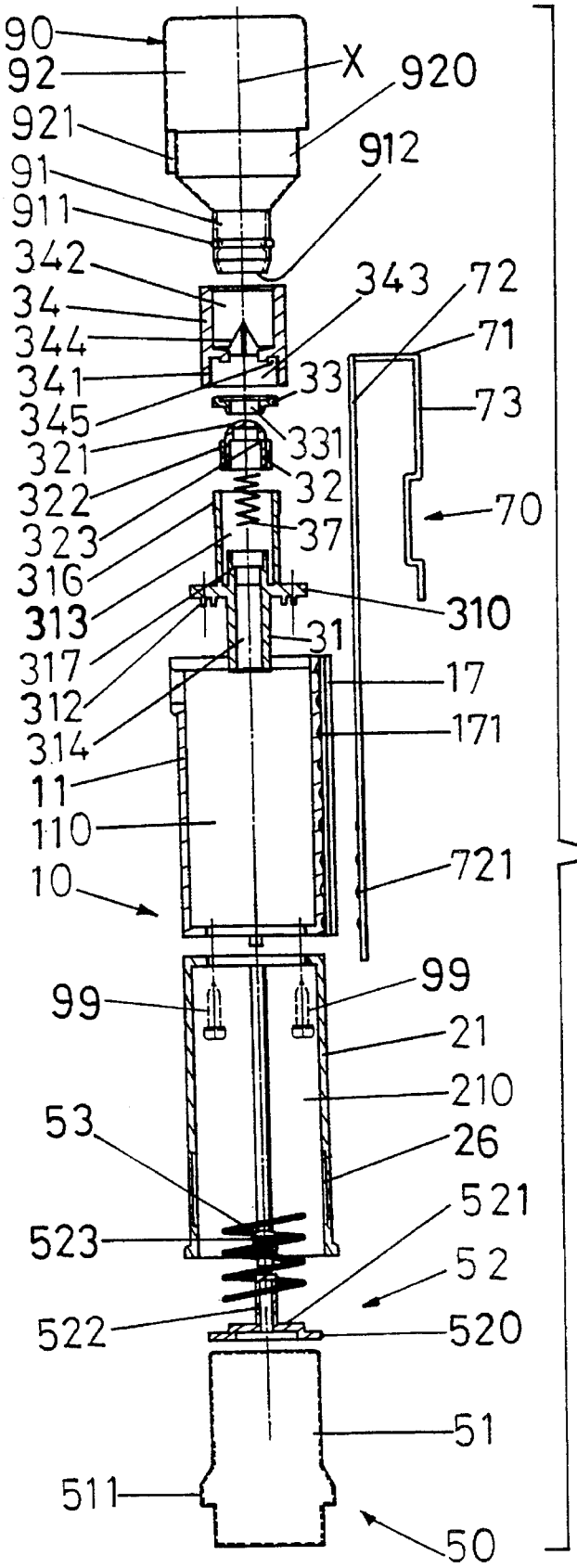
FIG. 3 is an exploded side view of the toilet disinfectant release apparatus of the present invention with parts thereof shown in section to illustrate the inside detail.

With reference to the drawings and in particular FIGS. 1 and 3, wherein a toilet disinfectant release apparatus constructed in accordance with a first embodiment of the present invention is shown, the toilet disinfectant release apparatus of the present invention comprises a housing 10 which is separated into an upper member 11 and a lower member 21. The upper housing member 11 defines therein a control chamber 110 having an open top side and a closed bottom side with a central hole 13 formed on the bottom. The open top of the upper housing member 11 has a convex support rim 12 on which a disinfectant container 90 having an edge 921 of complementary shape is supported and precisely positioned. The bottom of the upper housing member 11 further comprises an inclined flow passage 14 to be further explained hereinafter.

On a back side wall of the upper housing member 11, dovetail groove type connection means comprising two opposite slots 17 is provided to connect and thus fix the upper housing member 11 to hanger means 70 (to be described hereinafter). A plurality of pits 171 are formed on the back side wall of the housing member 11 and aligned in a line between and substantially parallel with the slots 17, serving to location-adjustably position the upper housing member 11 relative to the hanger means 70.

Figure 2:
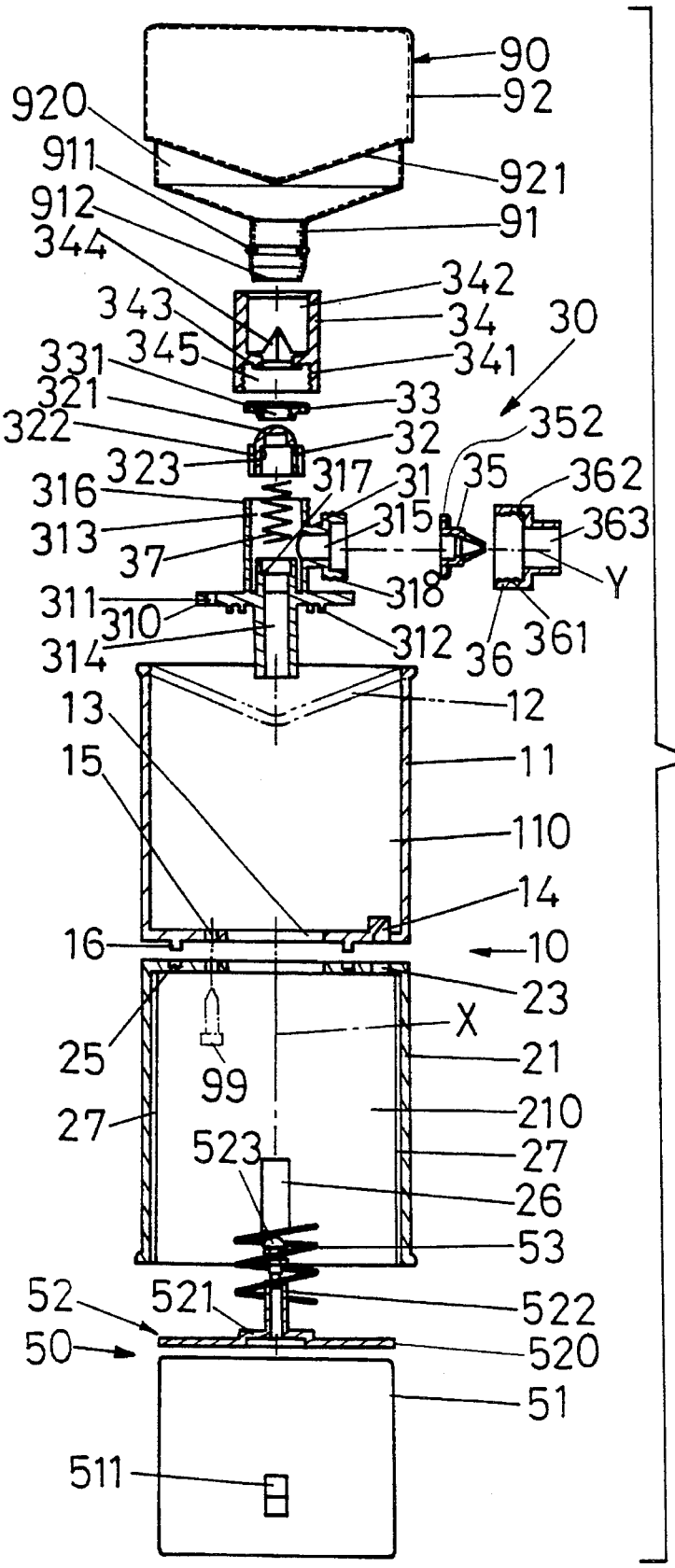
FIG. 2 is an exploded front view of the toilet disinfectant release apparatus of the present invention with parts thereof shown in section to illustrate the inside detail.

The lower housing member 21 defines therein a buoy chamber 210 having an open bottom side and a closed top side having a central hole 22 formed thereon, which top side is connected to the bottom of the upper housing member 11 by means of fasteners, such as screws 99 shown in FIGS. 2 and 3 in phantom lines, engaging screw holes 24 formed on the top of the lower housing member 21 and corresponding screw holes 15 formed on the bottom of the upper housing member 11. The housing 10 so formed by connecting the upper housing member 11 to the lower housing member 21 extends along a central axis X.

The central hole 22 formed on the top of the lower housing member corresponds in location to the central hole 13 of the bottom of the upper housing member 11. The lower housing member 21 also has a flow guiding hole 23 formed on the top thereof, corresponding to the inclined flow passage 14 of the upper housing member 11 to form a continuous flow passage when the lower housing member 21 is connected to the upper housing member 11.

Preferably, dowel pins 16 are provided on the bottom of the upper housing member 11 and corresponding pin holes 25 are formed on the top of the lower housing member 21 to provide precise positioning of the upper housing member 11 relative to the lower housing member 21.

The lower housing member 21 is also provided on an inside surface thereof two opposite, elongated recessed areas 26, extending in directions parallel with the axis X, which recessed areas 26 will be further described hereinafter.

The toilet disinfectant release apparatus of the present invention further comprises supply control means 30 disposed inside the housing 10. The supply control means 30 comprises a tubular body 31 extending along the axis X. The tubular body 31 comprises an upper section defining therein an upper interior space 313 serving as a disinfectant reservoir and a lower section defining therein a lower interior space 314 in communication with the disinfectant reservoir 313 and serving as a piston shaft, the upper section and the lower section being connected together and extending along the axis X of the tubular body 31. The tubular body 31 which further comprises a circumferential flange 310 formed thereon is so disposed within the upper housing member 11 to have the lower section thereof inserted into the lower housing member 21 through the central holes 13 and 22 of the upper and lower housing members 11 and 21 and the flange 310 thereof resting on and supported by the bottom of the upper housing member 11. The flange 310 is provided with inner-threaded holes 311 to allow the tubular body 31 to be secured on the bottom of the upper housing member 11 by means of the screws 99 that secure the upper and lower housing members 11 and 21 together.

Inside the disinfectant reservoir 313, a round-headed check 32 is movably disposed and biased by a spring 37. The check 32 is provided with an inner slot 323 for receiving and retaining a first end of the spring 37. A second end of the spring 37 is fixed on an inner shoulder 317 formed inside the tubular body 31.

Preferably, the check 32 is provided on outside surface thereof with axially-extending ribs 322 which helps smooth movement of the check 32 inside the disinfectant reservoir 313.

The tubular body 31 has an external thread 316 formed on the upper section thereof to engage a tube-like member 34, serving as a connector. The connector 34 has an interior space with a piercer 344 secured therein, which piercer 344 divides the interior space into an upper, disinfectant container holding space 342 and a lower, check receiving space 343 with a point of the piercer 344 pointing from the lower space 343 toward the upper space 342. The piercer 344 has such a cross section, preferably a cruciform one, as to provide communication passages between the upper space 342 and the lower space 343.

The lower space 343 has an inner-threaded lower opening 341 engageable with the external thread 316 of the tubular body 31 to secure the connector 34 to the tubular body 31. The connector 34 has formed in the lower space 343 thereof an inner shoulder 345 facing toward the tubular body 31 for supporting and retaining therein a seal ring 33 which has a central hole 331 serving as a flow passage. The check 32 and the spring 37 are so loaded into the disinfectant reservoir 313 that the check 32 is biased by the spring 37 toward the lower space 343 of the connector 34 and thus contactable and in flow tight engagement with the seal ring 33 to close the flow passage 331 of the seal ring 33 with the round head portion of the check 32.

The tubular body 31 of the supply control means 30 further comprises a tubular sideward extension 350 which extends along a direction Y, preferably substantially normal to the axis X of the tubular body 31, and to which a one-way nozzle 35 is connected. The connection of the nozzle 35 to the sideward extension 350 is provided by a cap 36 which has an inner space for fitting over the nozzle 35 and having an inner thread 361 to engage external thread 318 formed on the sideward extension 350. An inner shoulder 362 of the cap 36 abuts and thus holds a flange 352 of the nozzle 35 so as to retain the nozzle 35 on the sideward extension 350.

The nozzle 35 comprises a nozzle mouth 351 which is made of a resilient material, such as silicon rubber, that when interior pressure inside the nozzle 35 does not exceed a predetermined value, the nozzle mouth 351 is closed due to the resilience thereof to prevent fluid flow from forming across the nozzle mouth 351 and when the interior pressure exceeds the predetermined value, the resilience of the nozzle mouth 351 is overcome and the nozzle mouth 351 is forced to open and thus allows fluid flow to establish across the nozzle mouth 351. Due to the resilience of the material that makes the nozzle mouth 351, fluid is prevented from flowing into the nozzle 35 through the nozzle mouth 351 and thus providing a one-way nozzle structure.

The sideward extension 350 has a central bore 353 providing a fluid communication between the disinfectant reservoir 313 of the tubular body 31 and the nozzle 35. The cap 36 has an outlet 363 in fluid communication with the interior space of the cap 36 into which the nozzle 35 is disposed. With such an arrangement, once pressure inside the disinfectant reservoir 313 is greater than the predetermined value set by the nozzle mouth 351, the fluid inside the disinfectant reservoir 313 is allowed to be injected out of the supply control means 30 through the nozzle mouth 351 and the outlet 363 of the cap 36.

The toilet disinfectant release apparatus in accordance with the present invention further comprises buoy means 50 which includes a buoy 51 movably receivable within the buoy chamber 210 of the lower housing member 21. The buoy 51 is provided with two side projections 511 which are respectively receivable within and cooperating with recessed areas 26 to guide the buoy 51 to move inside the buoy chamber 210 along a direction parallel with the axis X, namely moving toward/away from the upper housing member 11. The recessed areas 26 also serve to determine the stroke of the movement of the buoy 51.

On the buoy 51, compressing means 52 is mounted, which comprises a support plate 520 fixed or supported on the buoy 51 with a centrally-located raised portion 521 formed thereon. An elongated rod member 522 is fixed to and extends from the raised portion 521 toward the upper housing member 11. A piston 523 is fixed on a free end of the rod member 522 and the rod member 522 has such a length to allow the piston 523 to be movably received within the piston shaft 314 formed inside the lower section of the tubular body 31 when the buoy 51 is received within the buoy chamber 210. The movement of the buoy 51 relative to the lower housing member 21 drives the piston 523 to move inside the piston shaft 314. The limitation of the movable distance imposed upon the buoy 51 by the recessed areas 26 also serves to determine the stroke of the piston 523 inside the piston shaft 314.

A biasing spring 53 is disposed between the flange 310 of the tubular body 31 and the support plate 520 by having a first end thereof received and retained within a circular groove 312 formed on the flange 310 and a second end thereof fit over and thus held by the raised portion 521 of the support plate 520 to push the buoy 51 away from the upper housing member 11.

The disinfectant container 90, serving as an external disinfectant supply source, comprises a container body 92 containing therein disinfectant and having a portion so configured as to be insertable into the control chamber 110 defined by the upper housing member 11 to have a mouth portion 91 thereof inserted into the upper, disinfectant container holding space 342 of the connector 34. The container mouth 91 has an opening sealed by a pierceable membrance 912, such as aluminum foil, so that when the disinfectant container 90 is inserted into the control chamber 110 of the upper housing member 11 to such a location that the edge 921 of the container 90 is resting on and supported by the convex support rim 12 of the upper housing member 11, the sealed mouth 91 is forced into the upper space 342 of the connector 34 and the sealing membrance 912 of the container mouth 91 is broken by being pierced through by the piercer 3.44 located inside the connector 34. This allows the disinfectant contained within the container 90 to flow through the communication passages formed by the piercer 344 and into the disinfectant reservoir 313 of the tubular body 31 via the flow passage 331 defined by the seal ring 33.

preferably, an O-ring 911 is provided on the mouth portion 91 of the disinfectant container 90 to provide fluid tightness between the mouth portion 91 of the container 90 and the upper space 342 of the connector 34.

Figure 6:
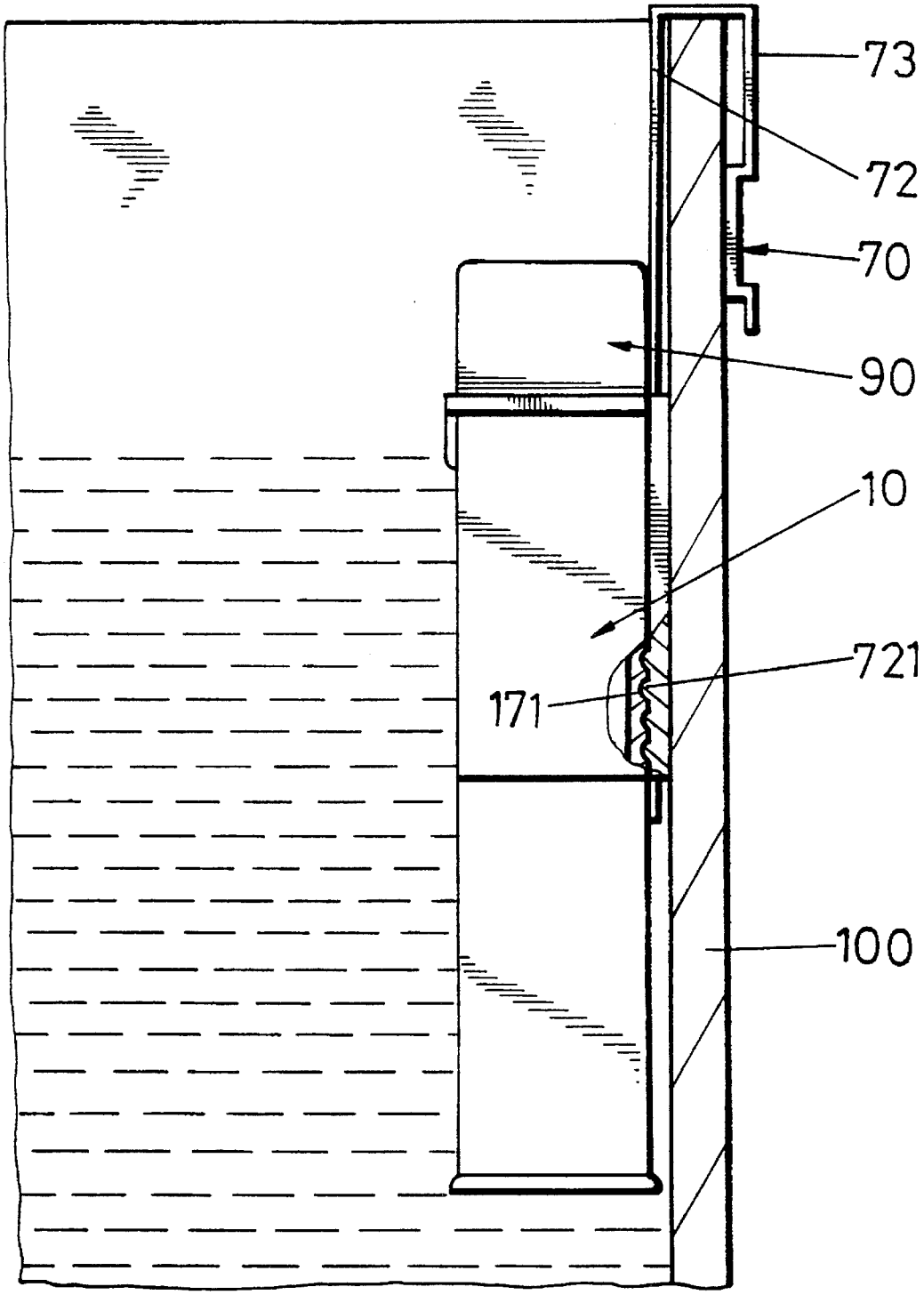
FIG. 6 is a partial side elevational view showing a toilet tank in which the toilet disinfectant release apparatus of the present invention is hung to release a substantially constant amount of liquid disinfectant into the toilet tank at each flush of the toilet.

The hanger means 70 comprises a U-shaped member 71 fit over a side wall of a toilet water tank 100, as shown in FIG. 6, having a tank holding section 73 located outside the tank 199 and a device supporting section 72 which is an elongated plate extending deeply into the tank 100 to have a lower end thereof dip into water contained inside the tank 100.

The device supporting section 72 of the hanger means 70 has such a width as to be receivable within between the two opposite slots of the dovetail groove type connection means formed on the back side wall of the upper housing member 11. The device supporting section 72 further comprises a plurality of bosses 721 formed thereon, corresponding and cooperating with the pits 171 formed on the back wall of the upper housing member 11 to provide adjustable positioning of the housing 10 relative to the hanger means 70. This allows the altitude of the buoy 51 to be adjustable relative to the toilet tank 100.

By fitting the U-shape member 71 of the hanger means 70 over the side wall of the toilet tank 100, as shown in FIG. 6, to have the housing 10 of the toilet disinfectant release apparatus of the present invention dip into the water inside the tank 100, the buoy 51 is moved upward by the buoyancy of the water so as to force the piston 523 to move upward and thus reduce the volume in which the disinfectant can take within the disinfectant reservoir 313 of the tubular body 31. This increases the pressure inside the disinfectant chamber 313 due to the fact that the flow passage 331 defined by the seal ring 33 is closed by the spring-biased check 32 and the nozzle mouth 351 is closed by the resilience thereof so as to make the disinfectant reservoir 313 a substantially sealed space. Once the pressure inside the disinfectant reservoir 313 reaches a pre-determined level which overcomes the resilience of the nozzle mouth 351, the nozzle mouth 351 is forced to open to allow the pressurized disinfectant inside the disinfectant reservoir 313 to be injected outward through the nozzle 35. This dispenses disinfectant of an amount determined by the size of the disinfectant reservoir 313 into the upper housing member 11.

During the upward movement of the buoy 51, the water within the buoy chamber 210 of the lower housing member 21 is forced by the buoy 51 to flow into the control chamber 110 of the upper housing member 11 through the flow guiding hole 23 formed on the top of the lower housing member 21 and the inclined flow passage 14 formed on the bottom of the upper housing member 11. The water flow which is guided to move in an inclined angle relative to the central axis X by the inclined flow passage 14 of the upper housing member 11 stirs the disinfectant injected into the control chamber 110 of the upper housing member 11 to allow the disinfectant to be fully mixed with the water.

When the toilet is flushed, the water level inside the toilet tank 100 lowers down and consequently, the buoy 51 moves downward with the water and no longer supports the piston 523 which is then pushed downward by the biasing spring 53. The downward movement of the piston 523 increases the volume of the disinfectant reservoir 313 so as to reduce the interior pressure inside the disinfectant reservoir 313. The decrease of the interior pressure inside the disinfectant reservoir 313 overcomes the biasing force of the spring 37 and thus allows the check 32 to move away from the seal ring 33 to open the flow passage 331. This allows the disinfectant inside the container 90 to be sucked into the disinfectant reservoir 313 due to the fact that the nozzle mouth 351 is closed by the resilience thereof so as to make the disinfectant chamber 313 a sealed space.

Further, the downward movement of the buoy 51 forces the water inside the control chamber 110 of the upper housing member 11, which is well mixed with disinfectant, to flow down into the buoy chamber 210 of the lower housing member 21 through the inclined flow passage 14 and the flow guiding hole 23 of the upper and lower housing members 11 and 21. The water that is mixed with disinfectant is then released to the toilet tank 100.

With such an arrangement, the disinfectant that can be injected at each flush is controlled by the stroke of the piston 523 or that of the buoy 51 so that by setting the distance of the stroke, the amount of disinfectant that is injected into the toilet tank 100 at each flush can be controlled to be substantially the same.

Figure 4:
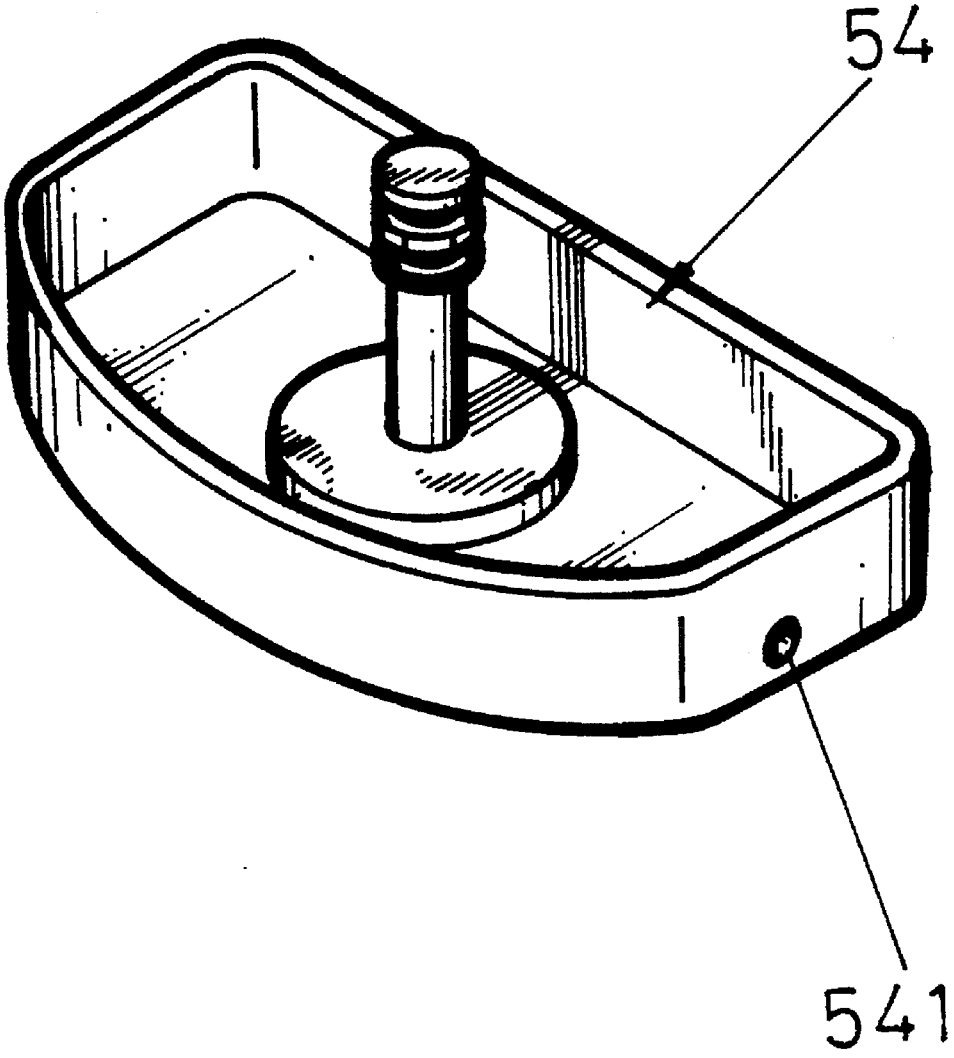
FIG. 4 is a perspective view showing a tray type piston support constructed in accordance with a second embodiment of the present invention.
Figure 5:
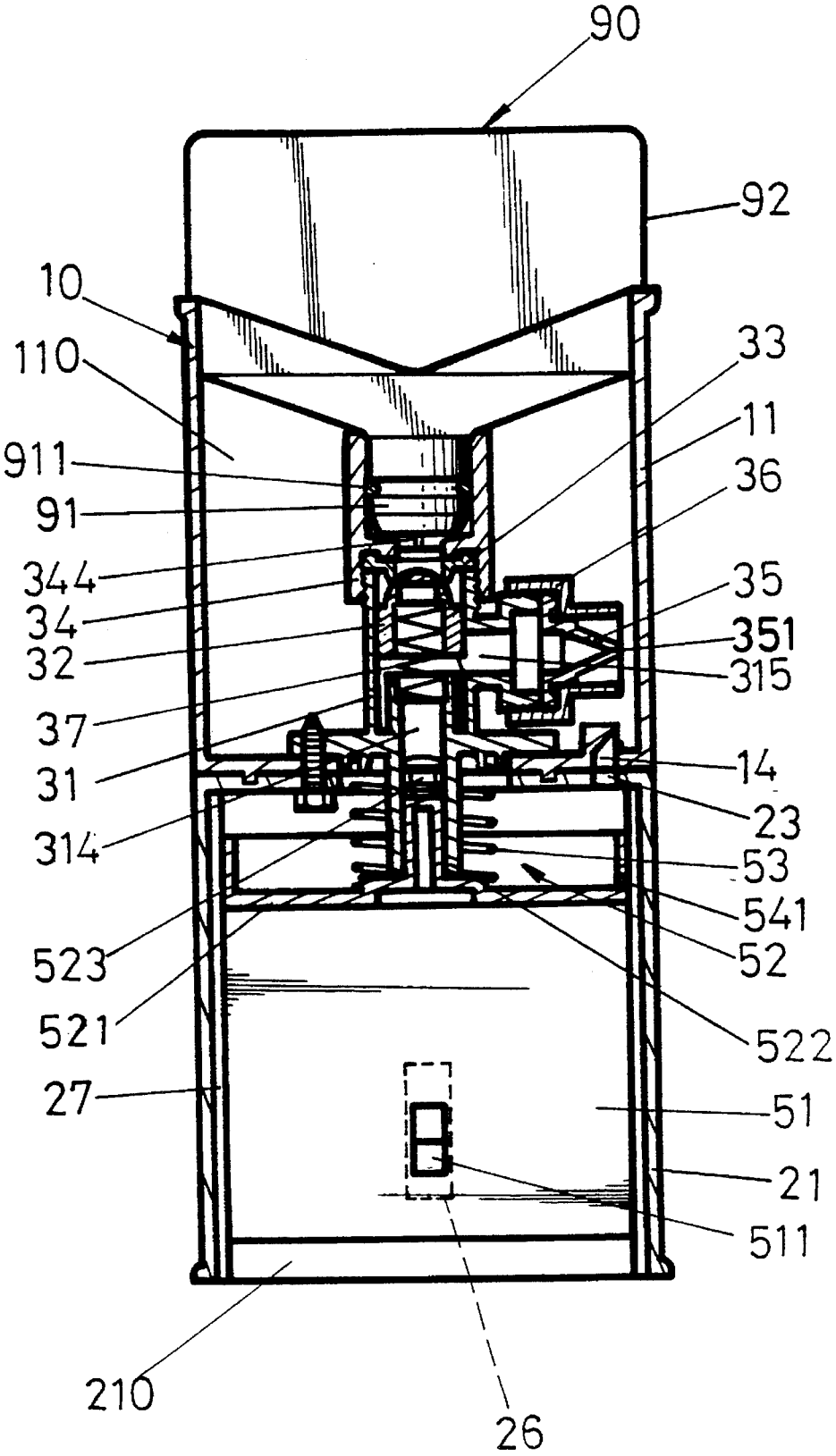
FIG. 5 is a cross-sectional view showing a toilet disinfectant release apparatus constructed in accordance with the second embodiment of the present invention.

With reference to FIG. 5, wherein a cross-sectional view of a second embodiment of the present invention is shown, the second embodiment of present invention comprises a tray member 54, particularly shown in FIG. 4, to replace the support plate 520 shown in FIGS. 1–3. The tray member 54 is provided with a water hole 541. The tray member 54 serves to contain an amount of water therein when the toilet tank 100 is re-filled with water and the buoy 51 is moved upward relative to the housing 10 after a flush. When the next flush occurs, the buoy 51 moves downward and the tray member 54 which has water contained therein is no longer supported by the buoy 51 moves quickly downward due to the biasing force of the spring 53 and the weight of the water contained within the tray member 54. This makes the apparatus of the present invention responds more quickly. The water hole 541 serves to drain the water contained within the tray member 54 when the tray member 54 moves downward.

It is quite apparent that the biasing spring 53 can be eliminated in the second embodiment because the place of the spring 53 can be taken by the tray member 54.

It is apparent that although the invention has been described in connection with the preferred embodiments, it is contemplated that those skilled in the art may make changes to the preferred embodiments without departing from the scope of the invention as defined in the appended claims.

What is claimed is:

1. A toilet disinfectant release apparatus to be disposed into a toilet tank which is filled with water for dispensing a substantial constant amount of liquid disinfectant contained within a container into the toilet tank to mix with the water, said apparatus comprising:

a housing defining therein a first interior space and having a top section on which a support rim is formed and a bottom section inside which guiding slots are formed, the housing being supported inside the toilet tank by means of hanger means supported on the toilet tank to have at least the lower section thereof dip into the water;

supply control means comprising a tubular body securely fixed inside the first interior space of the housing and extending along a central axis which is along an up–down direction, the tubular body defining therein an upper, disinfectant reservoir and a lower, piston shaft in communication with the disinfectant reservoir, a tubular sideward extension formed on the tubular body and extending along a direction not parallel with the central axis, the tubular sideward extension having an outlet in fluid communication with the disinfectant reservoir, a tube-like connector mounted to the disinfectant reservoir and having defined therein an upper space for receiving therein a mouth of the disinfectant container and a lower space with a flow passage formed therebetween, the lower space being in communication with the disinfectant reservoir, a check movably received within the disinfectant reservoir and biased by a first spring to enter the lower space of the connector for closing the first flow passage formed between the upper and lower spaces of the connector, a one way nozzle secured to an outlet of the sideward extension and having a nozzle mouth formed thereon for injecting the disinfectant into the housing;

a buoy up-and-down movably received within the lower section of the housing and having side projections respectively received within the guiding slots formed on the lower section of the housing to guide the up-and-down movement of the buoy within the housing;

first means for moving with the buoy, said means comprising an elongated rod extending therefrom with a piston secured on a free end thereof, the piston being movably receivable within the piston shaft; and second means for facilitating lowering down of the first means when the buoy lowers down with the water level inside the toilet tank.

2. The apparatus as claimed in claim 1, wherein the hanger means comprises a U-shaped member fit over a side wall of the toilet tank and a device support section extending from the U-shaped member to be receivably engageable with two opposite slots formed on side wall of the housing for supporting the housing inside the toilet tank, the housing comprising a plurality of pits of different altitudes formed between the two slots to cooperate with a plurality of bosses formed on the device support section of the U-shaped member for location-adjustably positioning the housing relative to the hanger means so as to adjust the location of the housing relative to the toilet tank.

3. The apparatus as claimed in claim 1, wherein the housing comprises an upper member defining the upper section of the housing and a lower member defining the lower section of the housing, the upper member having a closed bottom with a central hole formed thereon, the lower member having a closed top with a central hole formed thereon, the lower housing member being secured to the upper housing member by means of fasteners with the closed top thereof in contact with the closed bottom of the upper housing member and the central holes thereof overlapping each other to define a seat for receiving and supporting the tubular body which is secured on the closed top of the lower housing member by the fasteners, an inclined flow passage being formed on the closed top and bottom of the lower and upper members to guide water to flow into the upper housing member in an inclined manner.

4. The apparatus as claimed in claim 1, wherein the lower space of the connector has a seal ring fixed therein to define therein the flow passage which is closeable by having the check in fluid tight engagement with the seal ring.

5. The apparatus as claimed in claim 1, wherein the tubular body of the supply control means comprises an external thread formed thereon with which an inner thread of the connector is engageable.

6. The apparatus as claimed in claim 1, wherein the connector comprises a piercer secured therein with a point of the piercer facing the upper space of the connector and wherein the mouth of the disinfectant container comprises an opening sealed by a pierceable membrane to be broken by the piercer to allow the disinfectant contained inside the container to flow into the disinfectant reservoir.

7. The apparatus as claimed in claim 1, wherein the sideward extension of the tubular body comprises an external thread to which a cap member having an inner thread is threadingly connected, the cap having an interior space for receiving and holding therein the nozzle so as to secure the nozzle to the outlet of the sideward extension, the cap having an outlet to allow the disinfectant to flow out of the nozzle.

8. The apparatus as claimed in claim 1, wherein the second means comprises a second spring disposed between the tubular body and the first means to provide a downward biasing force to the buoy.

9. The apparatus as claimed in claim 8, wherein the tubular body comprises a spring holding groove formed thereon to receive and retain therein an end of the second spring.

10. The apparatus as claimed in claim 1, wherein the second means comprises a water tray to receive and contain therein water of which weight acts downward upon the buoy, the water tray comprising a hole for draining water contained therein.

11. The apparatus as claimed in claim 1, wherein the container comprises an edge having a configuration complementary to the support rim of the housing for precisely positioning the container on the housing.

12. The apparatus as claimed in claim 1, wherein the disinfectant container comprises an O-ring disposed around the mouth thereof to provide fluid tightness between the mouth and the upper space of the connector, the mouth of the disinfectant container having an opening sealed by a pierceable membrane.

* * * * *